US010422204B2

(12) United States Patent
Sampson et al.

(10) Patent No.: US 10,422,204 B2
(45) Date of Patent: Sep. 24, 2019

(54) SYSTEM AND METHOD FOR PERFORATING A WELLBORE

(71) Applicant: Baker Hughes Incorporated, Houston, TX (US)

(72) Inventors: Timothy Sampson, Tomball, TX (US); Stephen Zuklic, Humble, TX (US); Khaled Gasmi, Houston, TX (US); Brent W. Naizer, Tomball, TX (US); Rajani Satti, Spring, TX (US); Scott G. Nelson, Cypress, TX (US); Harold D. Brannon, Magnolia, TX (US); Jason McCann, Cypress, TX (US); James N. Gilliat, Spring, TX (US); Juan C. Flores, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 324 days.

(21) Appl. No.: 14/968,043

(22) Filed: Dec. 14, 2015

(65) Prior Publication Data

US 2017/0167233 A1 Jun. 15, 2017

(51) Int. Cl.
*E21B 43/117* (2006.01)
*E21B 43/26* (2006.01)
*E21B 43/263* (2006.01)

(52) U.S. Cl.
CPC ..... *E21B 43/117* (2013.01); *E21B 43/26* (2013.01); *E21B 43/263* (2013.01)

(58) Field of Classification Search
CPC ..... E21B 43/117; E21B 43/26
See application file for complete search history.

(56) References Cited

U.S. PATENT DOCUMENTS 4,724,105 A * 2/1988 Owen ..... B26F 3/04 102/307
6,386,288 B1 * 5/2002 Snider ..... E21B 43/117 166/298

(Continued)

FOREIGN PATENT DOCUMENTS

WO 2012154180 A1 11/2012

OTHER PUBLICATIONS

International Search Report and Written Opinion dated Mar. 3, 2017 of corresponding International Application No. PCT/US2016/065161.

(Continued)

*Primary Examiner* — Shane Bomar
(74) *Attorney, Agent, or Firm* — Hogan Lovells US LLP

(57) ABSTRACT

A system and method for stimulating hydrocarbon production from a wellbore that perforates the formation around the wellbore in strategic locations so that fractures can be formed in the formation having specific orientations. The system includes deep penetration perforators that extend past a portion of the formation adjacent the wellbore having locally high internal stresses (a stress cage); and big hole perforators that form perforations with a larger entrance diameter. The perforators form perforations in the formation that are axially consolidated along the wellbore. After perforating, the wellbore is hydraulically fractured with high pressure fluid, which creates fractures in a formation surrounding the wellbore that extend radially outward from the perforations. Creating perforations that are axially consolidated reduces the chances of forming competing fractures in the formation during fracturing.

17 Claims, 7 Drawing Sheets

(56) References Cited

U.S. PATENT DOCUMENTS

| | | | | |
|---|---|---|---|---|
| 7,172,023 | B2 * | 2/2007 | Barker | E21B 43/117 102/310 |
| 7,905,285 | B2 * | 3/2011 | Cuthill | E21B 43/1195 166/297 |
| 8,327,746 | B2 * | 12/2012 | Behrmann | E21B 43/117 102/208 |
| 2003/0188867 | A1 * | 10/2003 | Parrott | E21B 17/05 166/297 |
| 2005/0247447 | A1 * | 11/2005 | Spring | E21B 43/117 166/55.2 |
| 2007/0158109 | A1 | 7/2007 | Zazovsky et al. | |
| 2007/0240880 | A1 * | 10/2007 | Olsen | E21B 43/006 166/259 |
| 2008/0264639 | A1 | 10/2008 | Parrott et al. | |
| 2009/0283260 | A1 * | 11/2009 | Surjaatmadja | E21B 43/263 166/250.1 |
| 2013/0032347 | A1 | 2/2013 | Parker et al. | |
| 2015/0267516 | A1 | 9/2015 | Hardesty et al. | |
| 2016/0348484 | A1 * | 12/2016 | Allison | E21B 29/02 |
| 2017/0145798 | A1 * | 5/2017 | Robey | E21B 43/117 |
| 2017/0204713 | A1 * | 7/2017 | Bell | E21B 43/263 |

OTHER PUBLICATIONS

International Preliminary Examination Report on Patentability dated Jun. 28, 2018 for corresponding PCT/US2016/065161.

* cited by examiner

SYSTEM AND METHOD FOR PERFORATING A WELLBORE

BACKGROUND OF THE INVENTION

1. Field of Invention

The present disclosure relates to conducting wellbore operations using a perforating system having radial shaped charges. More specifically, the present disclosure relates to perforating a wellbore with a radial shaped charge and perforating.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically lined with a string of casing and cement is generally pumped into the annular space between the wellbore wall and the casing. Reasons for cementing the casing against the wellbore wall includes retaining the casing in the wellbore and hydraulically isolating various earth formations penetrated by the wellbores. Sometimes an inner casing string is included that is circumscribed by the casing. Without the perforations oil/gas from the formation surrounding the wellbore cannot make its way to production tubing inserted into the wellbore within the casing.

Perforating systems typically include one or more perforating guns connected together in series to form a perforating gun string, which can sometimes surpass a thousand feet of perforating length. The gun strings are usually lowered into a wellbore on a wireline or tubing, where the individual perforating guns are generally coupled together by connector subs. Included with the perforating gun are shaped charges that typically include a housing, a liner, and a quantity of high explosive inserted between the liner and the housing. When the high explosive is detonated, the force of the detonation collapses the liner and ejects it from one end of the charge at very high velocity in a pattern called a jet that perforates the casing and the cement and creates a perforation that extends into the surrounding formation. Each shaped charge is typically attached to a detonation cord that runs axially within each of the guns. Wellbore perforating sometimes is typically followed by hydraulic fracturing in order to promote production from the surrounding formation.

SUMMARY OF THE INVENTION

Disclosed herein are example systems and methods for wellbore operations. One example method of wellbore operations includes forming perforations in a formation that surrounds the wellbore by detonating shaped charges that are strategically disposed in a perforating gun so that the resulting perforations are axially consolidated, and generating a fracture in the wellbore that is in communication with the perforations and that is substantially perpendicular with an axis of the wellbore. The perforations can be formed using a deep penetration shaped charge, a big hole shaped charge, or combinations thereof. In an embodiment, a stress cage is defined in the formation adjacent the wellbore where internal stresses are greater than internal stresses in the formation distal from the wellbore, and wherein the perforation formed by the deep penetration shaped charge extends through the stress cage and radially outward past the stress cage. Optionally, the perforations are formed using a deep penetration shaped charge and a radial shaped charge. In this example, the deep penetration shaped charge and the radial shaped charge can be a single perforating gun and performed during the same trip into the wellbore; or can be in different perforating guns, and performed during different trips into the wellbore. The deep penetration charge can be spaced axially away from the radial shaped charge and oriented to detonate into the perforation formed by the radial shaped charge.

Included in another example of a method of wellbore operations is forming perforations in a formation that surrounds the wellbore and that has a stress cage in the formation that has localized increased internal stresses, and so that at least one of the perforations extends radially outward past the stress cage, and so that at least one of the perforations terminates in the stress cage and has an entrance diameter at least twice an entrance diameter of the perforation that extends past the stress cage, and pressurizing the wellborn to form a fracture in the formation that intersects with terminal ends of the perforations and that is in a plane that is substantially perpendicular with an axis of the wellbore. The portion of the wellbore having the perforations can be substantially horizontal, and wherein the perforation that extends radially outward past the stress cage can be substantially vertical. Optionally, the perforations extend along an axial length in the wellbore that is less than around 0.5 feet. The perforation that extends radially outward past the stress cage can intersect the perforation that terminates in the stress cage. In an alternative, shaped charges are used to form the perforations and that can be deep penetration shaped charges, big hole shaped charges, radial shaped charges, or combinations thereof.

Further disclosed herein is an example of a wellbore operations system for use in a wellbore and that includes a perforating gun that is made up of, a gun housing, a deep penetration shaped charge in the gun housing, a big hole shaped charge in the gun housing that is adjacent the deep penetration shaped charge, so that when the deep penetration shaped charge and the big hole shaped charge are detonated, perforations are formed in a formation surrounding the wellbore that are axially consolidated. The system can further include a hydraulic fracturing system. The deep penetration shaped charge selectively forms a perforation in the formation that extends radially past a stress cage in the formation. In one example, the big hole shaped charge selectively forms a perforation in the formation that terminates in the stress cage, and that has an entrance diameter that is at least twice that of an entrance diameter of a perforation formed by the deep penetration shaped charge. The big hole shaped charge can be made up of a radial shaped charge that forms a radial slot in a formation that is around the wellbore. Optionally, the deep penetration shaped charge forms a perforation in the formation that intersects the radial slot. The radial shaped charge can include an elongated housing having a cavity in which the radial shaped charge explosive is disposed. Embodiments exist wherein the gun housing is asymmetrically weighted, so that when disposed in a deviated wellbore, gravity rotates the gun housing so that the deep penetration and the big hole shaped charge are in a designated orientation.

BRIEF DESCRIPTION OF DRAWINGS

Some of the features and benefits of the present invention having been stated, others will become apparent as the description proceeds when taken in conjunction with the accompanying drawings, in which.

Figure 6:
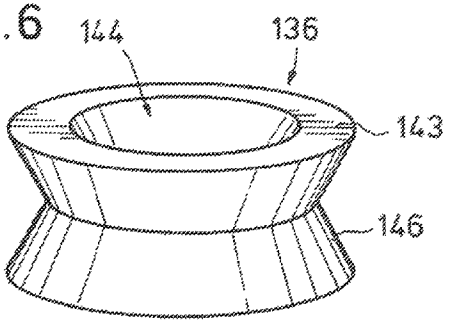
FIG. 6 is a perspective view of an example of the radial shaped charge of FIG. 4.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
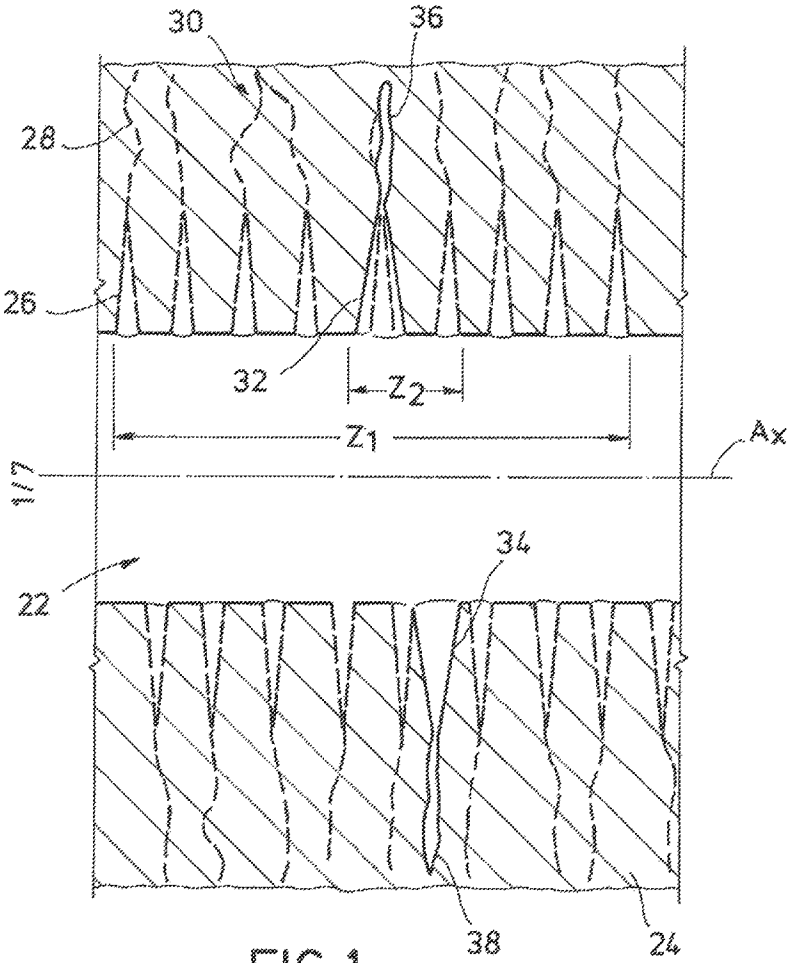
FIG. 1 is a side sectional view of an example of a comparison of fractures created in a formation after traditional perforating versus fractures created after axially consolidated perforating in the formation.

FIG. 1 shows in a side sectional view an example of a wellbore 22 formed through a formation 24, where the wellbore 22 can be vertical, horizontal, or otherwise deviated. Perforations 26 are depicted in the formation 24 that extend from an outer radius of the wellbore 22. Perforations 26 are shown in a dashed outline to represent the perforations 26 being formed from a known technique that creates the perforations 26 at axially spaced apart locations along a perforating zone $Z_1$. Further, adjacent ones of the perforations 26 can be formed at different azimuthal locations about the axis $A_X$ of the wellbore 22, such as in a spiral pattern. By introducing pressurized fracturing fluid into the wellbore 22, fractures 28 can be produced in the formation 24 that extend radially outward from the perforations 26 in a direction away from the wellbore 22. However, the close proximity of the perforations 26 can cause some of the fractures 28 to migrate towards one another, and intersect, to form competing fractures 30. Competing fractures 30 limit the production capacity of the perforations associated with those fractures 30.

In one embodiment of the method and system described herein perforations 32, 34 are formed in the formation 24 at axially consolidated locations along the length of the wellbore 22. In an embodiment, the term axially consolidated refers to concentrating perforations along a portion of an axial length of wellbore 22 that is significantly less than the portion of the wellbore 22 that is typically perforated. In one example, the portion of the axial length of wellbore 22 that perforations 26 extend is defined as a perforating zone $Z_1$, perforating zone $Z_1$ is around 4 feet to around 8 feet. In contrast, perforations 32, 34 of FIG. 1 extend along a perforating zone $Z_2$ that ranges from around 0.5 to 1.5 feet. As shown, fractures 36, 38 are shown extending from the terminal ends of perforations 32, 34 respectively. Consolidating the perforations 36, 38 along a smaller perforating zone $Z_2$ concentrates the force applied to the formation 24 by the pressurized fracturing fluid (not shown) during the step of fracturing, thereby creating fractures 36, 38 that are wider and longer than fractures 28 that correspond to the perforations 26 made along the axially longer perforating same $Z_1$. In one example, fractures 36, 38 propagate along the circumference of the wellbore 22 and join one another to form a single fracture (not shown) that circumscribes wellbore 22, and is along a plane that is substantially perpendicular to axis $A_X$. In contrast, propagation of fractures 28 can tend to form circumferential fractures that are generally oblique to axis $A_X$ rather than being perpendicular or substantially perpendicular.

In an embodiment, perforations 32, 34 of FIG. 1 are "big hole" perforations and were formed with a big hole shaped charge or perforator, and which is different from the conventional or deep penetration shaped charges used to form perforations 26. Thus in an example perforations 32, 34 are shorter than perforations 26, but have a larger diameter that perforations 26. Examples exist wherein big hole perforations have entrance diameters that range from about 0.5 inches to about 1.2 inches and have lengths from about 0.2 inches to around 8 inches. Deep penetration or conventional shaped charges that can be used to form perforations 26, that in one example have entrance diameters that range from about 0.2 inches to around 0.5 inches, and have lengths ranging from up to around 10 inches to in excess of 60 inches. An advantage of forming perforations 32, 34 to be big hole perforations instead of conventional or deep penetrating perforations, such as perforations 26, is that during fracturing the pressure drop through the perforations 32, 34 is less than that of perforations 26, which leaves more pressure (and thus force) for creating the subsequent fractures 36, 38.

Figure 2A:
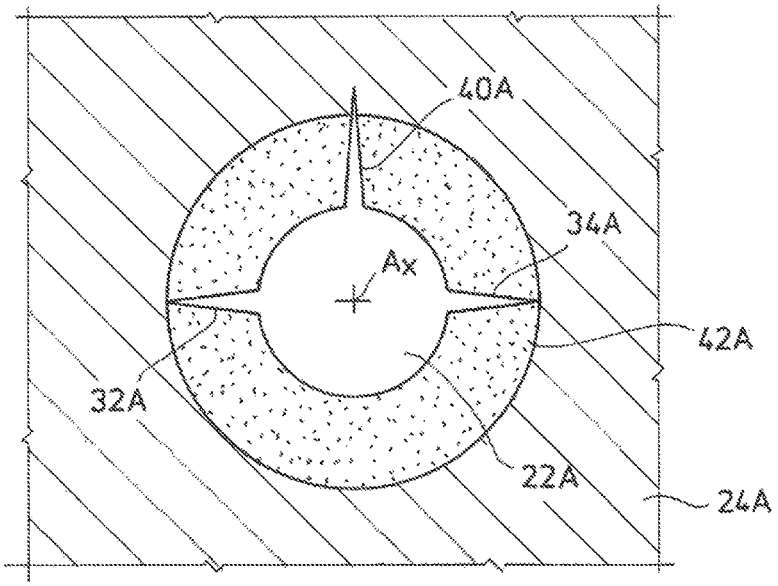
FIG. 2A is an axial sectional view of an example of perforations formed in a formation surrounding a wellbore.

FIG. 2A shows an axial sectional view of another example of a wellbore 22A in a formation 24A, and where perforations 32A, 34A, 40A project radially outward from the wellbore 22A into the formation 24A. In the example of FIG.

2A, the perforation 32A, 34A, 40A are spaced angularly apart from one another around the circumference the wellbore 22A and are axially consolidated as described above. In an embodiment, perforations 32A, 34A, 40A span an axial length of wellbore 22A that ranges up to around 0.5 feet, up to around 10 feet, up to around 1.5 feet, up to around 2.0 feet, or any distance up to around 2.0 feet. Also shown in FIG. 2A is a stress cage 42A in the formation and in an area that circumscribes wellbore 22A. In one example, the stress cage 42A is a portion of the formation 24A having higher internal stresses, which can result from stresses introduced while forming the wellbore 22A, i.e. from a drill bit boring through the formation 24A. As shown in the example of FIG. 2A is that perforation 40A extends past the outer radial perimeter of stress cage 42A into the formation 24A, whereas perforations 32A, 34A each terminate within the stress cage 42A. Further in this example, perforation 40A is not a big hole perforation, but a conventional perforation formed with a conventional or deep penetration shaped charge (not shown); and whereas perforations 32A, 34A are big hole perforations and formed with big hole shaped charges. However, any number of combinations of perforations types is possible, such as all perforations 32A, 34A, 40A being the same type and formed with the same type of shaped charge (i.e. conventional, deep penetration, or big hole), or a single one of perforations 32A, 34A, 40A formed with a big hole shaped charge and the other two being formed with a conventional or deep penetration shaped charge.

Figure 2B:
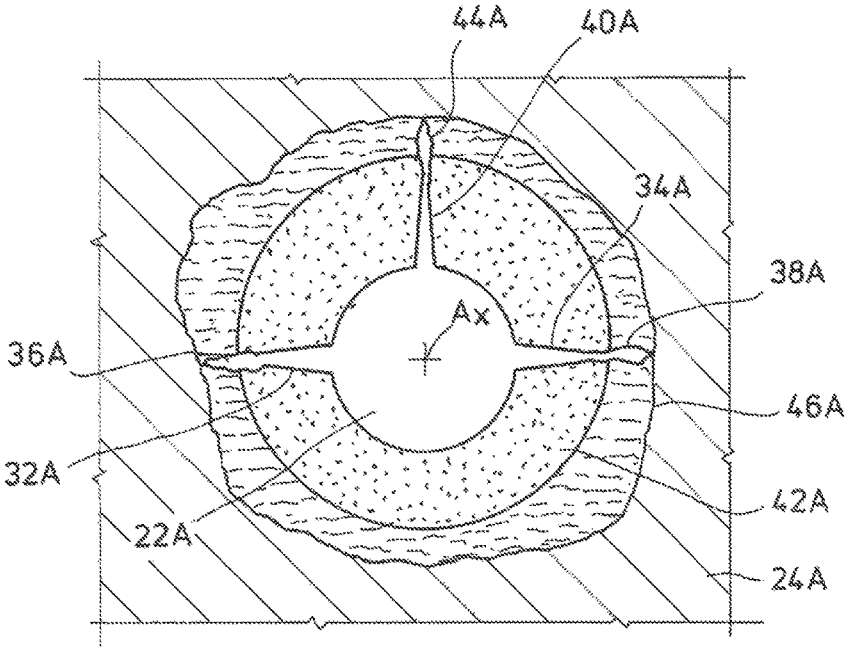
FIG. 2B is an axial sectional view of the example of FIG. 2A after fracturing in the wellbore.

Referring now to FIG. 2B, shown are fractures 36A, 38A, 44A that extend from the ends of perforations 32A, 34A, 40A respectively. In an example, fractures 36A, 38A, 44A are formed by introducing fracturing fluid into the wellbore 22A at a pressure sufficient to overcome internal stresses in the formation 24A and stress cage 42A adjacent the terminal ends of perforations 32A, 34A, 40A. An advantage of forming at least one of the perforations 32A, 34A, 40A that terminates past the stress cage 42A, and in the formation 24A, is that the internal stresses in the formation 24A are less than internal stresses in the stress cage 42A. Thus less force is required for forming the fracture 44A; meaning fracture 44A will likely extend farther into the formation 24A. Examples exist wherein a pressure required for fracturing in the stress cage 42A is around 6200 pounds per square inch ("psi"), whereas fracturing in virgin and undamaged formation past the stress cage 42A can be done at pressures of around 5000 psi. Additionally, as less force is required to form fracture 44A, an increased amount of remaining force from the pressurized fracturing fluid can be applied to creating fractures 36A, 38A, to thereby maximize their width and length. Further illustrated in FIG. 2B is a fracture plane 46A, which circumscribes wellbore 22A and is created by the cooperative effect of fractures 36A, 38A, 44A. In the example, fracture plane 46A is generally perpendicular to axis $A_X$ of wellbore 22A. Optionally, perforations 32A, 34A are formed from big hole perforators, and thus will have a larger entrance hole diameter than if formed from conventional or deep penetration perforators, and can allow for an increased flow of production fluid into the wellbore 22A. Further optionally, perforation 40A is formed using a conventional deep penetration shaped charge to ensure its terminal end extends past the stress cage 42A and into the formation 24A.

Figure 3A:
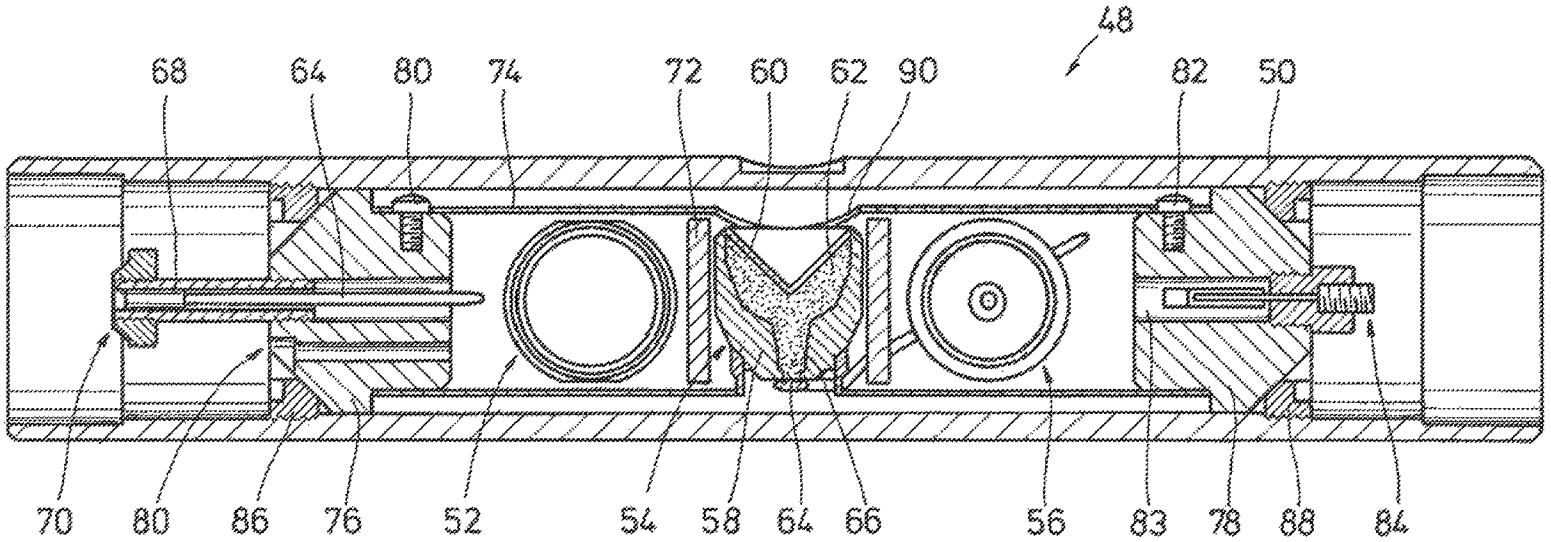
FIGS. 3A and 3B are side sectional and perspective partial sectional views of an example of a perforating gun for use in perforating the wellbore of FIGS. 1, 2A, and 2B.

Shown in a side sectional view in FIG. 3A is an example of perforating gun 48 for use in perforating wellbore 22, 22A. Perforating gun 48 includes an annular gun housing 50 in which shaped charges 52, 54, 56 are stowed. Each shaped charge 52, 54, 56 includes a housing 58 having an opening that forms a cavity, a frusto-conical liner 60 set in the cavity in the housing 58, and high explosive 62 between the liner 60 and a bottom of the cavity in the housing 58. A detonating cord 64 is routed through the housing 50 and to each of the shaped charges 52, 54, 56. An initiator 66 in the base of each housing 58 has a small amount of explosive that when initiated by detonation of the detonating card 64, in turn causes detonation of the high explosive 62 in each housing 58. A detonator 68 is provided on an end of the detonating cord 64, and that converts an electrical signal to explosive energy to start a detonation wave in the detonating cord 64. The detonator 68 is shown coaxially disposed within a connector 70 that provides for quick connection to an upstream component for electrical or explosive communication for initiation of the detonation cord 64.

Optionally, propellant 72 is shown disposed adjacent the shaped charges 52, 54, 56, and that can be initiated to react in response detonation of the shaped charges 52, 54, 56. The propellant 72 is shown as disk like members, and which when reacted converts to gas that increases pressure in the wellbore 22A (FIG. 2B) to contribute to fracturing of the formation 24A. The shaped charges 52, 54, 56 are mounted in an annular gun tube 74 that inserts within gun housing 50. Cylindrically shaped end caps 76, 78 insert into opposing ends of the gun tube 74 and are secured thereto by fasteners 80, 82 that respectively project radially through gun tube 74 and into end caps 76, 78. A bore 83 extends axially through end cap 78 and in which an electrical connector 84 is inserted, wherein connector 84 provides communication between the perforating gun 48 and surface, as well as to other perforating guns (not shown) that may be connected to gun 48. Annular nuts 86, 88 are shown abutting the respective outer surfaces of end caps 76, 78 and which secure the gun tub 74 within the housing 50.

Figure 3B:
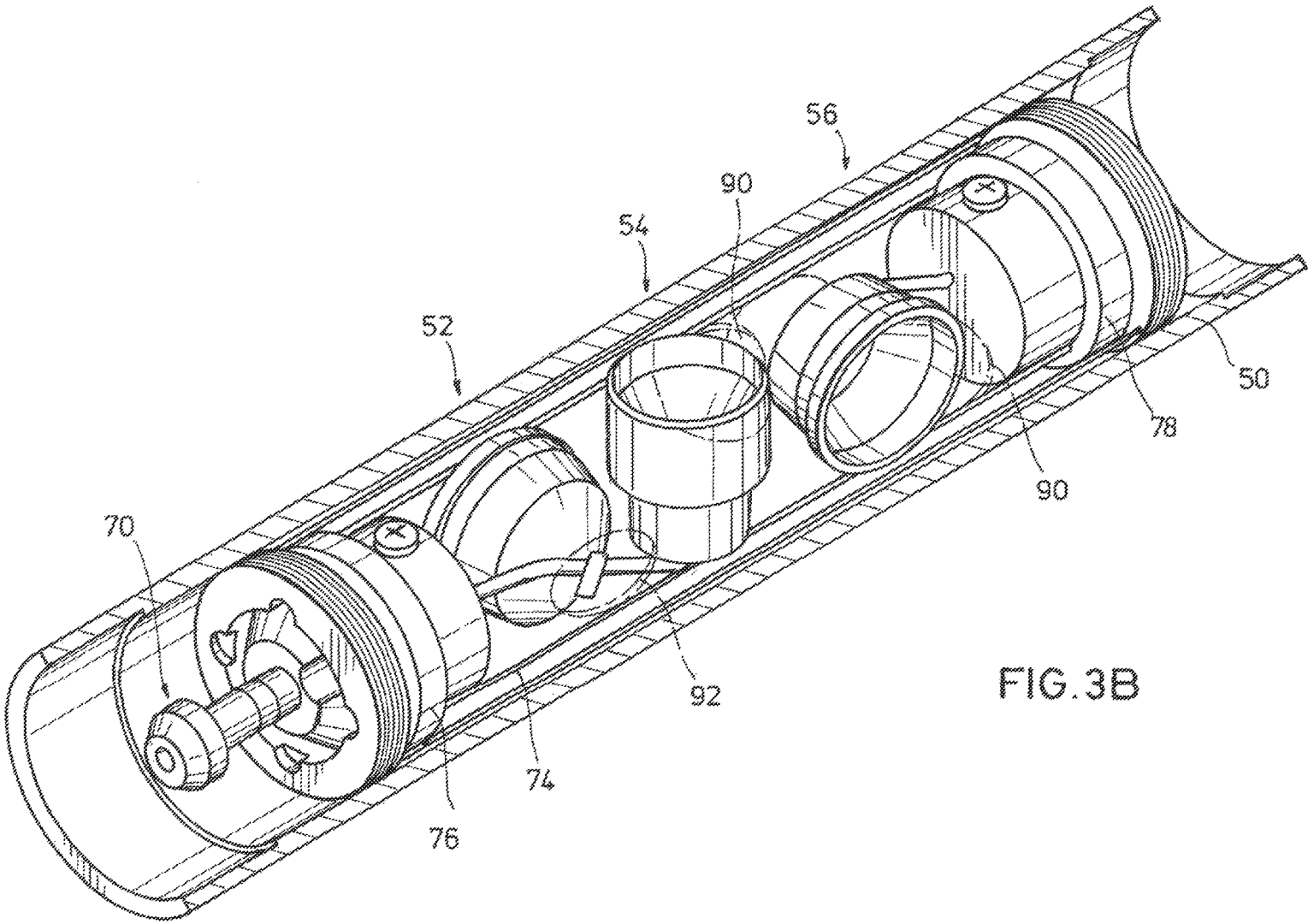

Referring now to FIG. 3B, openings are shown formed through the side wall of the gun tube 74 and which register with the open ends of the housings 58 (FIG. 3A) of the shaped charges 52, 54, 56. Openings 92 are also shown in the gun tube 74 and which correspond to the bottom end of the housings 58 and which provide access for connecting detonation cord 64 to the shaped charges 52, 54, 56. Optionally, the shaped charges 52, 54, 56 of FIGS. 3A and 3B are oriented roughly 90° to one another, and thus are configured to create the perforations 32A, 34A, 40A of FIG. 2A. In one embodiment, perforation 40A is substantially vertically oriented and perforations 32A, 34A are substantially horizontally oriented. The gun housing 50 can include weights (not shown) that are strategically positioned to asymmetrically weight the housing 50 so that when the gun 48 is in a deviated or horizontal portion of the wellbore 22, the weight will orient the gun 48 to form the perforations 32A, 34A, 40A in a designated orientation. Further optionally, the shaped charges 52, 56 are big hole shaped charges, whereas shaped charge 54 is a conventional or deep penetration shaped charge. Moreover, examples exist where the spacing between shaped charge 52 and shaped charge 56 ranges from up to around 0.5 feet, or up to around 1.5 feet, or any value in between. Thus when using the perforating gun 48 of FIGS. 3A and 3B, axially consolidated perforations can be formed in a formation surrounding a wellbore. As discussed above, advantages of axially consolidated perforations include the ability to avoid competing fractures. A further advantage of axially consolidating perforations is the ability to create fractures having openings that are larger than openings of conventionally formed fractures, i.e. fractures at the ends of perforations created using conventional methods.

As such, the method and system described herein can be used to complete a wellbore that has an increased hydrocarbon production.

Figure 4:
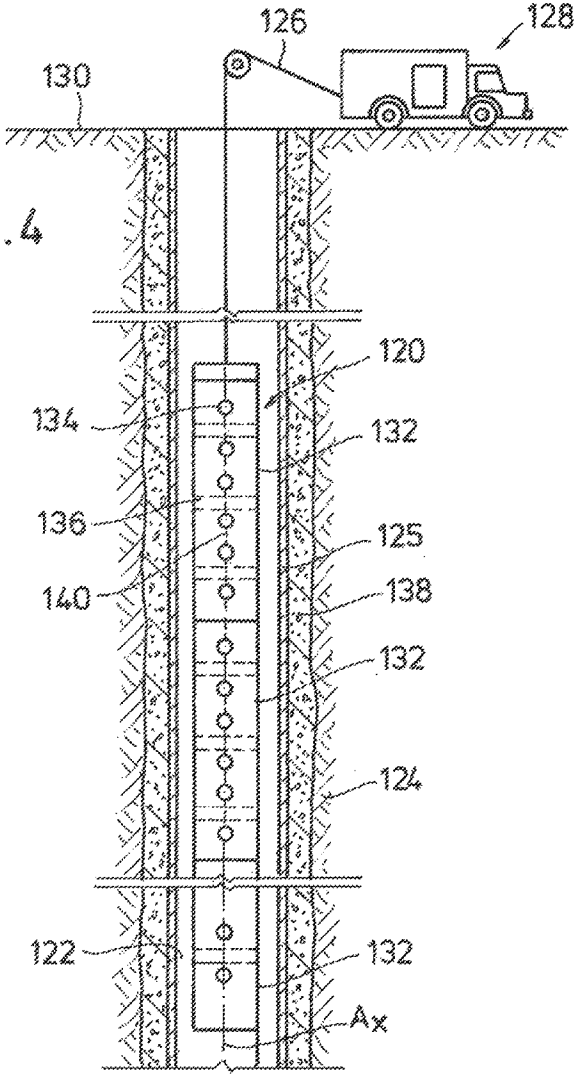
FIG. 4 is a side partial sectional view of an example of a perforating system with radial and standard shaped charges and disposed in a wellbore.

Shown in a side partial sectional view in FIG. 4 is one example of an alternate embodiment of a perforating string 120 disposed in a wellbore 122; where wellbore 122 intersects a subterranean formation 124. Casing 125 lines the wellbore 122, and as shown provides a flow barrier between the formation 124 and wellbore 122. A wire line 126 is used toward deploying the perforating string 120, and which has an end opposite perforating string 120 that mounts to a surface truck 128 shown on surface 130. Perforating string 120 is an elongated cylindrically shaped member and which is made up of gun bodies 132 that are mounted together in series. Various connectors (not shown) may be used for connecting together the gun bodies 132. In the gun bodies 132 are conventional/standard shaped charges 134 and radial shaped charges 136. In the example of FIG. 4, the standard shaped charges 134 are spaced axially away from the radial shaped charges 136. In an embodiment, the shaped charges 134, 136 form corresponding perforations that are axially consolidated as described above.

Figure 5:
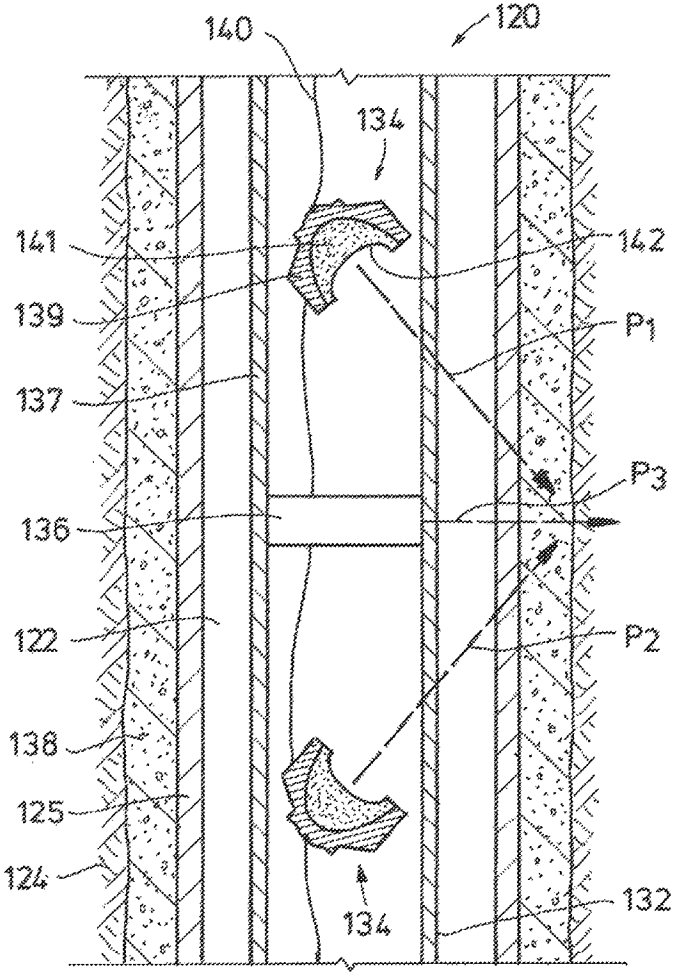
FIG. 5 is a side sectional view of an example of the perforating system of FIG. 4.
Figure 11:
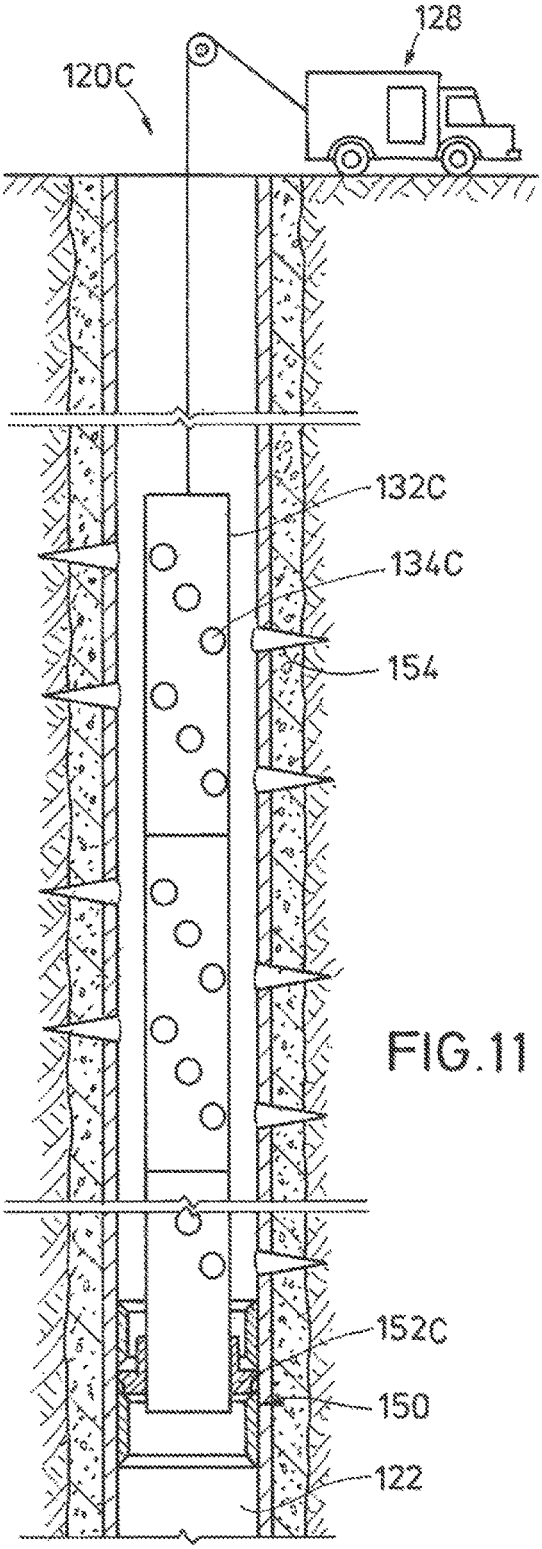

FIG. 5 shows in a side sectional view a portion of an example of the perforating string 120 in wellbore 122 of FIG. 4. Here, shaped charges $\mathbf{134}_1$, $\mathbf{134}_2$ are shown on opposing lateral sides of the radial shaped charge 136; shaped charges $\mathbf{134}_1$, $\mathbf{134}_2$ are oriented so that when detonated metal jets from shaped charges $\mathbf{134}_1$, $\mathbf{134}_2$ travels respectively along paths $P_1$, $P_2$. More specifically, each of the shaped charges $\mathbf{134}_1$, $\mathbf{134}_2$ is shown having a shaped charge case 139 that has an end connecting to a detonating cord 140. A signal from surface track 128, via wire line 126, initiates a detonation wave front within detonation cord 140, that in turn initiates detonation of explosive 141 shown provided within shaped charge cases 139. Detonation of explosive 141 inverts liners 142 in the shaped charges $\mathbf{134}_1$, $\mathbf{134}_2$ that are disposed on a side of explosive 141 opposite from shaped charge case 139. In one example of operation, radial charge 136 is first detonated, which forms a metal jet along path $P_3$, and then at a later time shaped charges $\mathbf{134}_1$, $\mathbf{134}_2$ are detonated, which are oriented to form a perforation in the formation 124 at substantially the same place where radial charge 136 forms a slot in formation 124. The combination of the radial charge 136 and the conventional shaped charges $\mathbf{134}_1$, $\mathbf{134}_2$ creates perforations in the formation 124 whose flow areas are consolidated axially along wellbore 122. Further illustrated in FIG. 11 is cement 138 disposed between the casing 125 and formation 124. Thus a perforations formed by shaped charges $\mathbf{134}_1$, $\mathbf{134}_2$ would necessarily intersect a perforation formed by shaped charge 136, thereby forming axially consolidated perforations. In one example shaped charge 136 generates a perforation having dimensions consistent with a big hole shaped charge as defined above and shaped charges $\mathbf{134}_1$, $\mathbf{134}_2$ include deep penetrating shaped charges as defined above.

Figure 7:
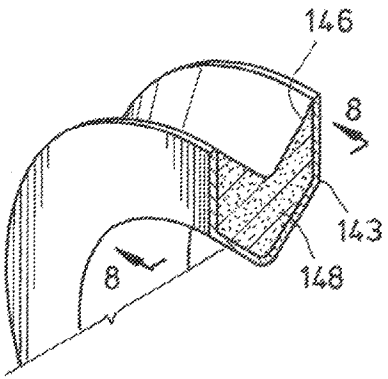
FIG. 7 is a perspective partial sectional view of an example of the radial shaped charge of FIG. 4.
Figure 8:
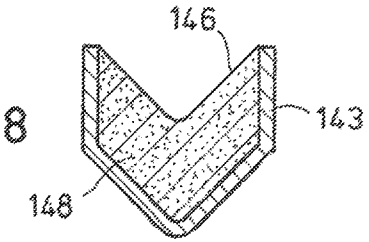
FIG. 8 is a radial sectional view of the radial shaped charge of FIG. 7 and takes along lines 8-8.
Figure 12:
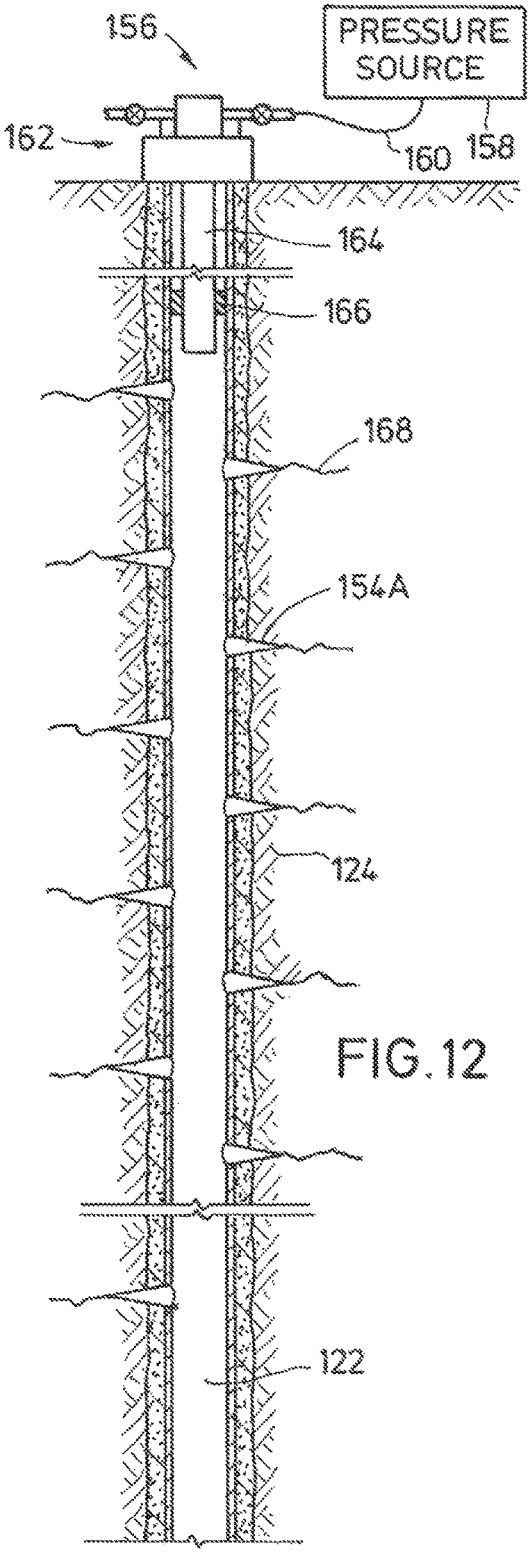
FIG. 12 is a sectional view of an example of creating hydraulic fractures in a formation surrounding the wellbore of FIG. 4.

FIGS. 6 through 8 illustrate various views of an example of the radial shaped charge 136. Referring to FIG. 12, radial shaped charge 136 is shown in a perspective view and illustrating that radial shaped charge 136 has a generally annular shape and also has an annular case 143. An axial bore 144 extends through case 143. A liner 146 having a "V" shaped cross-section is provided on the outer periphery of case 143. Illustrated in FIG. 10, which is a side perspective and partial cutaway view of radial shaped charge 136, is that explosive 148 is disposed in a cavity formed on the outer radial surface of case 143. Explosive 148 sets below liner 146 so that detonation of explosive 148 in turn forms a metal jet created by collapsing of liner 146. FIG. 8, which is taken along lines 8-8 of FIG. 7, illustrates the "V" shaped look of the liner 146 and the explosive 148 within case 143.

Figure 9:
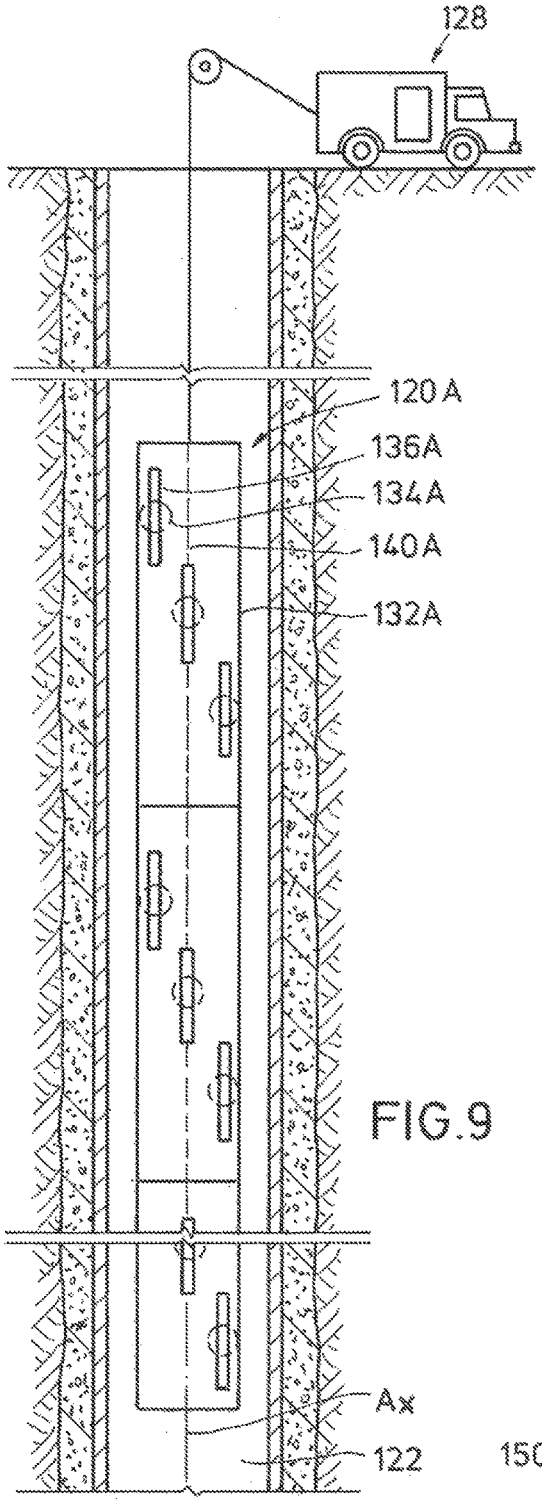
FIG. 9 is a side partial sectional view of an alternate example of the perforating system of FIG. 4.

FIG. 9 shows in side partial sectional view an alternate embodiment of perforating string 120A, and wherein perforating string 120A also includes a number of gun bodies 132A that are stacked in series. In this embodiment, radial shaped charges 136A are shown formed within gun bodies 132A, however, their elongate distances are oriented to be substantially parallel with an axis $A_X$ of wellbore 122. The orientation of radial shaped charges 136A of FIG. 9 is different from the orientation of the radial shaped charges 136 of FIG. 10. In one example, the radial shaped charges 136A of FIG. 9 are referred to as linear shaped charges and have an elongate case with a "V" shaped cavity therein for high explosive and having a corresponding "V" shaped liner on a side of the explosive distal from the bottom end of the cavity.

Figure 10:
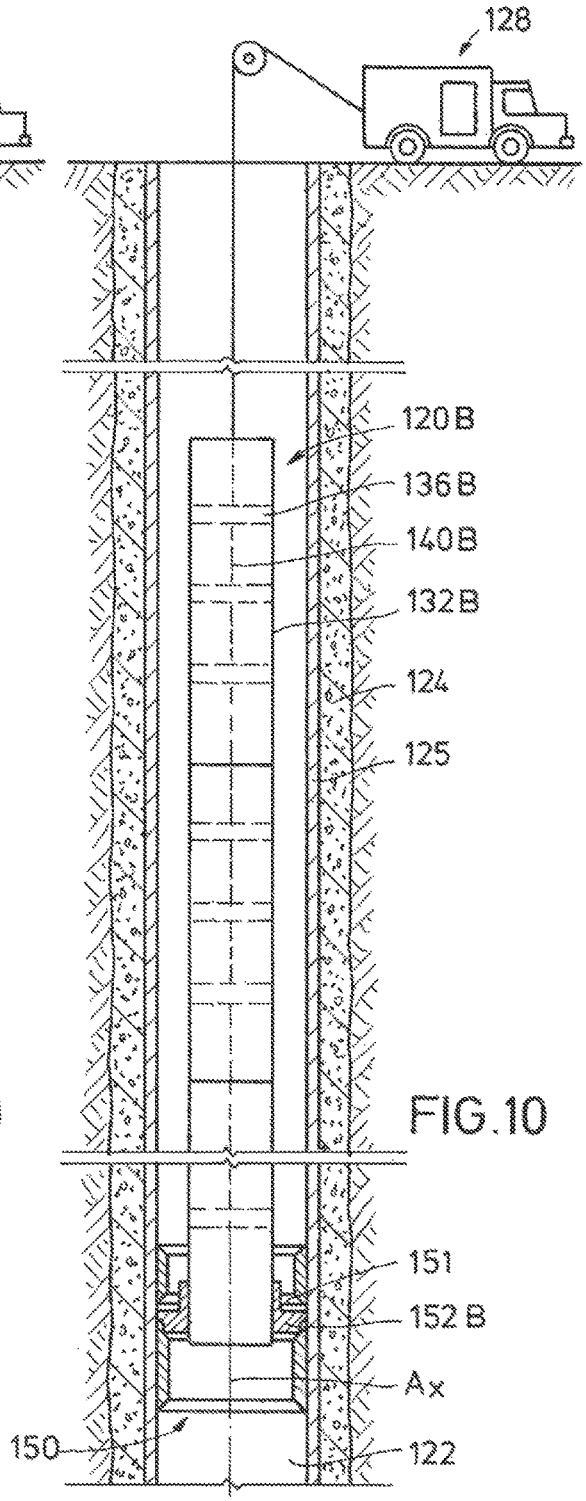
FIGS. 10 and 11 are side partial sectional views of an alternate example of perforating the wellbore of FIG. 4.

FIGS. 10 and 11 show in a side partial sectional view an alternate method of forming perforations within the formation 124. Referring now to FIG. 10, shown is one embodiment of the perforating string 120B disposed in wellbore 122; wherein perforating string 120B has radial charges 136B that circumscribe an axis $A_X$ of the perforating string 120B. The standard shaped charges are not included in the perforating string 120B of FIG. 10. A landing profile 150 is shown formed within casing 125 and which has indentations 151 that receive a protrusion from a locating tool 152B that is provided with the perforating string 120B. Strategic locating of the landing profile 150 and locating tool 152B allows for precise locating of the individual radial shaped charges 136B so that when the radial shaped charges 136B are detonated, elongated slots can be formed in designated depths within formation 124. Referring now to FIG. 11, perforations 154 are shown that result from detonation of the radial charges 136B of FIG. 10. A locating tool 152C similar to a locating tool 152B of FIG. 10 is provided on perforating string 120C which is disposed in wellbore 122. As such, the standard shaped charges 134C provided in gun bodies 132C may be aligned with perforations 54 and can be directed into those perforations 154 to create perforations 154A (FIG. 12) having a consolidated flow area. Thus, in this example illustrated in FIGS. 10 and 11, instead of a single perforating string inserted into the wellbore 122, at least two trips of different perforating strings 120B, 120C are disposed in wellbore 122 to complete the job of creating the perforations 154.

FIG. 12 shows in a side sectional view one example of a fracturing step wherein a fracturing system 156 is added to wellbore 122. More specifically, fracturing system 156 includes a pressure source 158, which is one example is a fracturing pump discharges pressurized fluid into a line 160. The fluid flows in line 160 to a wellhead assembly 162, where line 160 is routed to a pipe 164 shown mounted on a lower end of wellbore assembly 162. Packers 166 are shown optionally formed around pipe 164 for isolating the pressurized fluid that exits the pipe 164 into the wellbore 122. With sufficient amount of pressurization, fractures 168 are shown extending into the formation 124 from ends of the perforations 154A distal from wellbore 122. Fracturing system 156 can be employed to create fractures 36, 38 of FIG. 1, and Fractures 36A, 38A, 44A of FIG. 2B.

One advantage of the method described herein is that the consolidated flow areas of the perforations are consolidated axially along the wellbore 122, which reduces the chances of creating multiple competing fractures within the formation 124. This improves the effectiveness of fracture treatments, such as in horizontal wells. Further, it should be pointed out that gravitational systems may be used with the perforating string 120, such as in the example of FIG. 11, so that when in a horizontal section of a wellbore, the perforating string can be moved into a designated orientation so that the resulting perforations may be directed to a specific side of the wellbore 122. Further, examples exist for the perforation areas concentrated in a very short axial space along the wellbore 122. The advantages also address the issues of perforation friction, stress cage effects, and low side bridging in addition to eliminating the problem of competing fractures. As the radial shaped charge 136 creates fairly large slot openings the conventional shaped charges 134 are used to penetrate beyond the stress cage of the wellbore 122. Thus, a sufficiently large perforating diameter and sufficient penetration is formed with the combination of these shaped charges 134, 136 to extend beyond the stress cage. In one alternative to using wireline, coil tubing could be used, such as in combination with the locating tool, to reshoot to the same location with the second perforating string 120C.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of wellbore operations comprising:

a. forming perforations that are axially consolidated in a formation surrounding the wellbore and that are directed angularly away from one another around a circumference of the wellbore, the perforations being formed with shaped charges that are in a single perforating gun and each shaped charge oriented in a direction substantially perpendicular to an axis of the wellbore; and b. generating a fracture in the formation that is in communication with the perforations and that is substantially perpendicular with the axis of the wellbore.

2. The method of claim 1, wherein the shaped charges consist of three shaped charges.

3. The method of claim 1, wherein the perforations are all within a perforating zone that ranges from about 0.5 feet to about 1.5 feet along a length of the wellbore.

4. The method of claim 1, wherein the perforations are formed using no more than three shaped charges, and wherein the perforations are within an arc of 180 degrees and that are all within an axial span of up to 1.5 feet.

5. The method of claim 4, wherein the wellbore is a horizontal wellbore and where the perforations are all substantially perpendicular with the axis of the wellbore, and wherein the first perforation is oriented in a direction generally vertically, and the second perforation and the third perforation are oriented in a direction generally horizontally.

6. The method of claim 4, wherein the first shaped charge is a deep penetration shaped charge, the second shaped charge is a big hole shaped charge, and the third shaped charge is a big hole shaped charge.

7. A method of wellbore operations comprising:

a. obtaining a housing for a perforating gun;

b. installing up to three shaped charges in the perforating gun to define an upper shaped charge, a middle shaped charge, and a lower shaped charge;

c. orienting each shaped charge so that when the shaped charge is detonated a jet projects from each shaped charge that is substantially perpendicular to an axis of the housing; and d. spacing the shaped charges so that a distance between the upper and lower shaped charges is no more than 1.5 feet.

8. The method of claim 7, further comprising pressurizing the wellbore to form a fracture.

9. The method of claim 8, wherein the fracture circumscribes the wellbore in a plane that is substantially perpendicular to the wellbore.

10. The method of claim 7, wherein the first shaped charge is a deep penetration shaped charge, and the second shaped charge and the third shaped charge are big hole shaped charges.

11. A wellbore operations system for use in a wellbore comprising:

a perforating gun comprising, a gun housing, a first shaped charge in the gun housing, a second shaped charge in the gun housing that is axially adjacent the first shaped charge, and having an opening that is oriented at an angle about an axial axis of the housing that is away from an opening in the first shaped charge, so that when the first and second shaped charges are detonated, perforations are formed in a formation surrounding the wellbore that are axially consolidated and spaced angularly away from one another around a circumference of the wellbore; wherein the second shaped charge is a big hole shaped charge that comprises a radial shaped charge having an annular housing that circumscribes an axis of the wellbore and a liner on an outer radius of the housing, the radial shaped charge forming a radial slot in the formation that is around the wellbore.

12. The system of claim 11, further comprising a hydraulic fracturing system.

13. The system of claim 11, wherein the first shaped charge comprises a deep penetration shaped charge which selectively forms a perforation in the formation that extends radially past a stress cage in the formation.

14. The system of claim 11, wherein the second shaped charge has an entrance diameter that is at least twice that of an entrance diameter of a perforation formed by the first shaped charge.

15. The system of claim 11, wherein the first shaped charge is a deep penetration shaped charge which forms a perforation in the formation that intersects a perforation formed by the big hole shaped charge.

16. The system of claim 11, further comprising a locating tool that selectively engages a landing profile strategically disposed at a depth in the wellbore.

17. The system of claim 11, wherein the gun housing is asymmetrically weighted, so that when disposed in a deviated wellbore, gravity rotates the gun housing so that the first and second shaped charge are in a designated orientation to form perforations in the formation that are spaced about 180° from one another about an axis of the wellbore.

* * * * *